US007731563B2

(12) United States Patent
Saucier

(10) Patent No.: US 7,731,563 B2
(45) Date of Patent: Jun. 8, 2010

(54) TRANSFORMABLE TOY

(76) Inventor: Aldric J. Saucier, 106 Canal St., Grasonville, MD (US) 21638

( * ) Notice: Subject to any disclaimer, the term of this patent is extended or adjusted under 35 U.S.C. 154(b) by 166 days.

(21) Appl. No.: 11/944,126

(22) Filed: Nov. 21, 2007

(65) Prior Publication Data

US 2008/0070471 A1 Mar. 20, 2008

Related U.S. Application Data

(63) Continuation of application No. 10/889,488, filed on Jul. 12, 2004, now Pat. No. 7,306,504.

(51) Int. Cl.
*A63H 3/00* (2006.01)

(52) U.S. Cl. ..... 446/487; 446/268

(58) Field of Classification Search ..... 446/72, 446/73, 268, 321, 487
See application file for complete search history.

(56) References Cited

U.S. PATENT DOCUMENTS

| | | | |
|---|---|---|---|
| 152,250 | A | 6/1874 | Powers |
| 3,520,078 | A | 7/1970 | Klamer |
| 4,411,097 | A | 10/1983 | Murakami |
| 4,571,199 | A | 2/1986 | Murakami |
| 4,575,348 | A | 3/1986 | Wiggs |
| 4,581,904 | A | 4/1986 | Lehmann et al. |
| 4,605,383 | A | 8/1986 | Horiuchi |
| 4,674,990 | A | 6/1987 | Ohno |
| 4,687,459 | A | 8/1987 | Lockett |
| 4,696,656 | A | 9/1987 | Torres et al. |
| 4,708,687 | A | 11/1987 | Goldberg et al. |
| 4,817,936 | A | 4/1989 | Matsuda |
| 4,874,340 | A | 10/1989 | Smallwood |
| 5,019,010 | A | 5/1991 | Nikaido et al. |
| 5,090,935 | A | 2/1992 | Monson |
| 5,090,938 | A | 2/1992 | Reynolds |
| 5,098,327 | A | 3/1992 | Ferrero |
| 5,209,345 | A | 5/1993 | Haugabook |
| 5,310,378 | A | 5/1994 | Shannon |
| 5,855,499 | A | 1/1999 | Yamazaki et al. |
| 6,126,507 | A | 10/2000 | Lieberman |
| 6,203,393 | B1 | 3/2001 | Flynn |
| 6,231,346 | B1 | 5/2001 | Sagi-Dolev |
| 6,261,146 | B1 | 7/2001 | Spector |

(Continued)

FOREIGN PATENT DOCUMENTS

| | | |
|---|---|---|
| EP | 0337960 | 10/1989 |

(Continued)

*Primary Examiner*—John Ricci
(74) *Attorney, Agent, or Firm*—K&L Gates LLP

(57) ABSTRACT

A transformable toy is presented. The toy includes a first member, a second member and a third member. A first surface of the first member is a first part of an exterior surface of a substantially spherical structure in a first configuration. A second surface of the second member is a second part of the exterior surface of the substantially spherical structure in the first configuration. The first member and second member are positionable in a second configuration in which at least a portion of the second member is further from at least a portion of the first member. The at least portion of the second member includes an edge which includes an arc-shaped portion. The first member, second member and third member are positionable in a third configuration.

18 Claims, 3 Drawing Sheets

U.S. PATENT DOCUMENTS

| | | | |
|---|---|---|---|
| 6,261,149 | B1 | 7/2001 | Moore |
| 6,572,436 | B1 | 6/2003 | So |
| 6,638,136 | B1 | 10/2003 | Lee et al. |
| 6,719,606 | B1 | 4/2004 | Mukensturm |
| 6,752,679 | B1 | 6/2004 | Lui |
| 2003/0176146 | A1 | 9/2003 | Norman |

FOREIGN PATENT DOCUMENTS

| | | |
|---|---|---|
| FR | 2559072 | 8/1985 |
| GB | 2 123 795 | 2/1984 |
| JP | 57-126289 | 1/1956 |
| JP | 58-126893 | 8/1983 |
| JP | 58-165881 | 9/1983 |
| JP | 60-128693 | 8/1985 |
| JP | 61-115593 | 7/1990 |

TRANSFORMABLE TOY

RELATED APPLICATIONS

This patent application is a continuation of U.S. Non-Provisional application Ser. No. 10/889,488, filed on Jul. 12, 2004, the entire contents of which is incorporated herein by reference.

BACKGROUND

Toys provide excitement and enjoyment for children. Toys come in several different sizes, shapes, configurations and perform many different functions. Some toys have a limited number of functions. Toys with a limited number of functions or uses tend to quickly lose childrens' interest.

Accordingly, there is need for toys with multiple functions and different uses to enhance childrens' excitement, enjoyment and interest with the toys.

SUMMARY

The present invention generally refers to a toy and specifically, to a transforming toy including opposable movable members which pivot toward or away from each other to reveal or conceal a figurine.

In one embodiment, the transforming toy includes a first movable member and a second movable member. The first movable member has a semi-circular shape and includes the top portion of the figurine. Specifically, the inside surface of the first movable member includes a body, a first revealing member or first revealer positioned adjacent to and movably connected to the top of the body and a pair of second revealers movably connected to each side of the body. In one embodiment, the first revealer is configured to be a head having a face and the second revealers are each configured to be arms.

In one embodiment, the second movable member has a semi-circular shape and includes the lower portion of the figurine. The size and shape of the second movable member corresponds to the size and shape of the first movable member. The second movable member includes a support and a third revealing member or third revealer movably connected to the support. In this embodiment, the support is configured to be a pair of legs and the third revealer is configured to be a pair of feet.

In one embodiment, the first and second movable members are each movably connected to a coupler or hinge positioned between the first and second movable members. The first movable member is connected to one end of the coupler. The second movable member is movably connected to a different or opposite end of the coupler. The coupler is adapted to enable the first and second movable members to independently move toward each other until the first and second members are substantially adjacent to each other or in a closed position. The coupler is also adapted to enable the first and second movable members to move away from each other until the first and second movable members are in a substantially open position.

The transforming toy of the present invention enables children to move the first and second movable members toward or away from each other to reveal or conceal the figurine connected to the inside surface of the first and second movable members.

When the transforming toy is in the closed position, the transforming toy may be rolled, thrown or bounced like a toy ball. To convert or transform the toy into a figurine, a user opens or separates the first and second movable members and moves the first and second movable members away from each other. The user then moves or rotates the first revealer or head to reveal the head having the face. The user then moves or rotates the second revealers or arms away from the body to reveal the arms of the figurine. Next, the user moves or rotates the third movable member or feet of the figurine downwardly away from the support to a substantially perpendicular or transverse position with respect to the support. In the open position, a user such as a child can use the transforming toy as a movable figurine, decorative display or according to any other suitable function.

Although in the above embodiment, the transforming toy includes a figurine which may be revealed or concealed inside the toy, it should be appreciated that the transforming toy may include any suitable figurine, character, shape, image or configuration.

In another embodiment, the first and second movable members have generally square shape and move toward each other to form a cube in the substantially closed position. It should be appreciated that the first and second movable members can be any suitable size or shape.

It is therefore an advantage of the present invention to provide a transformable toy which transforms into different toys.

It is another advantage of the present invention to provide a transformable toy that transforms into different toys having different functions.

Additional features and advantages of the present invention are described in, and will be apparent from, the following Detailed Description of the Invention and the figures.

DETAILED DESCRIPTION

The present invention generally refers to a toy and specifically, to a transformable toy adapted to open and close to reveal and conceal a figurine.

Figure 1:
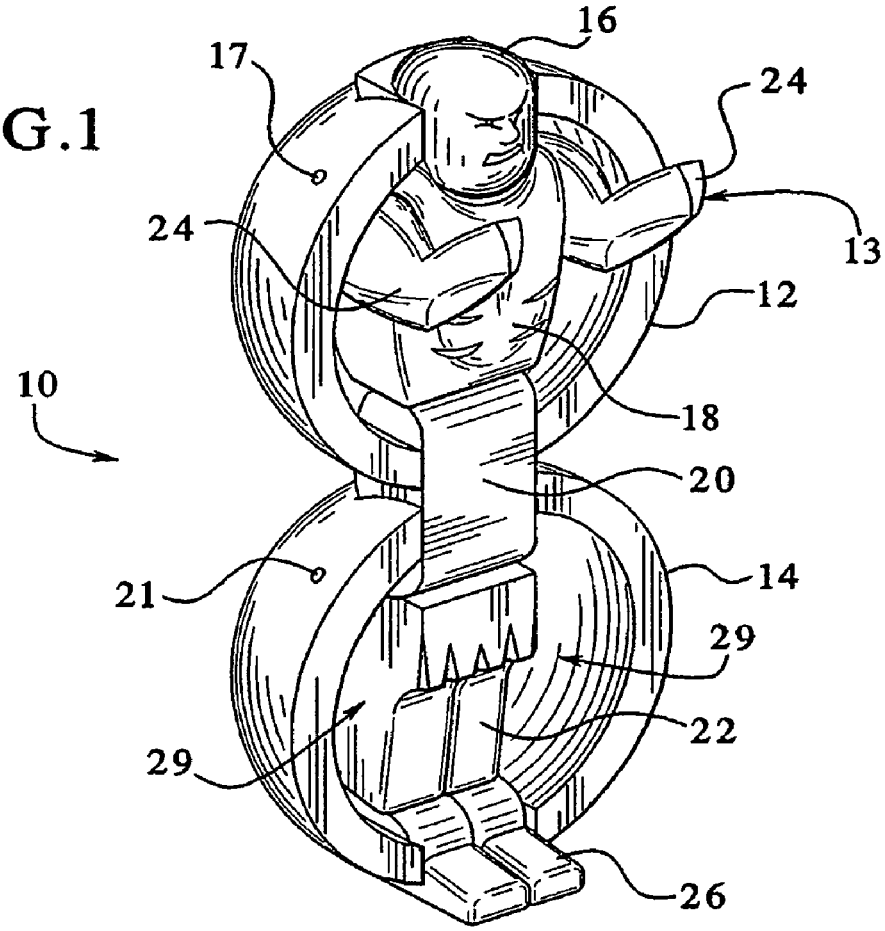
FIG. 1 is an enlarged perspective view of one embodiment of the transformable toy of the present invention illustrating the transformable toy in an open position.
Figure 2:
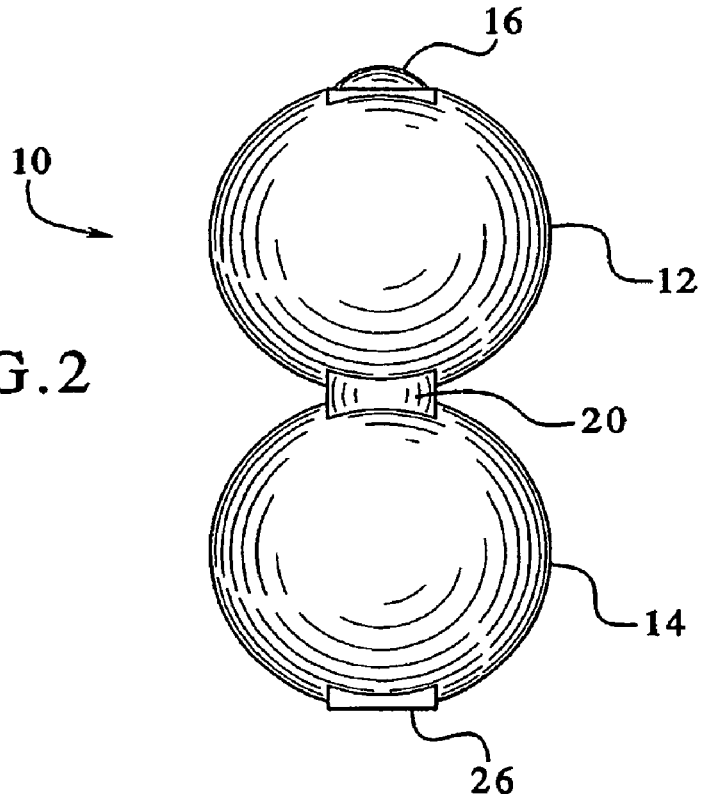
FIG. 2 is a rear view of the embodiment of FIG. 1.
Figure 3:
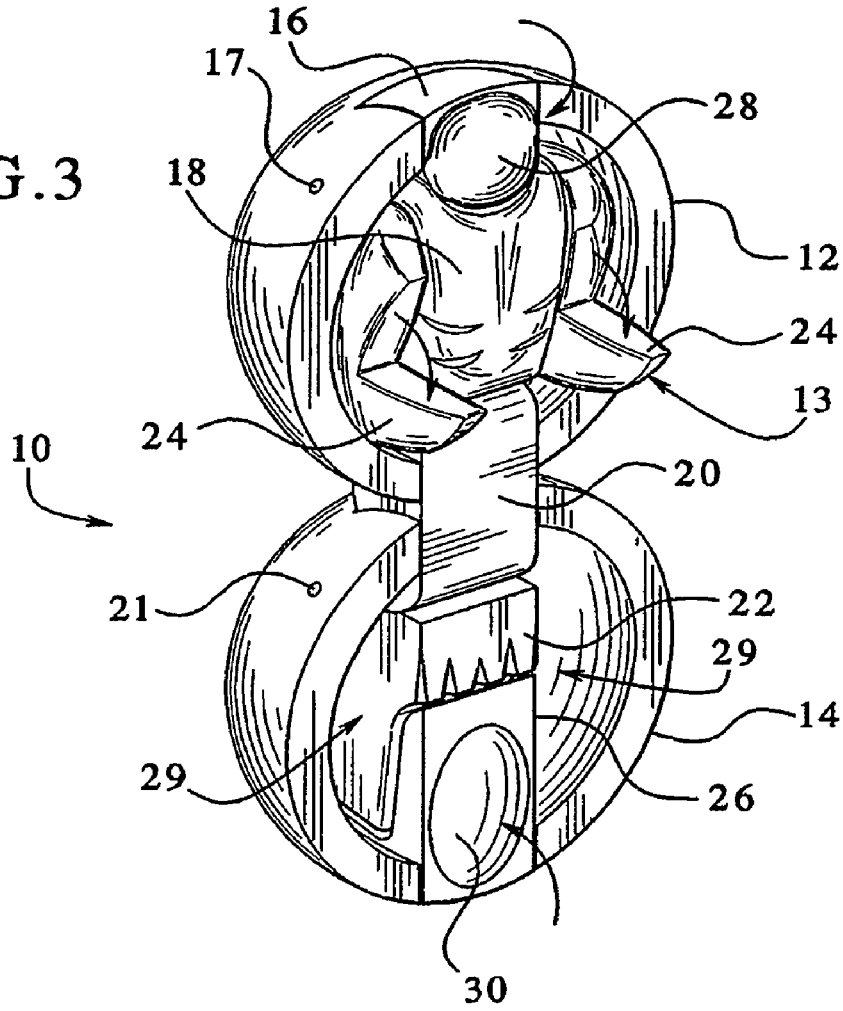
FIG. 3 is an enlarged perspective view of the embodiment of FIG. 1 illustrating the movement of the different revealers.
Figure 4:
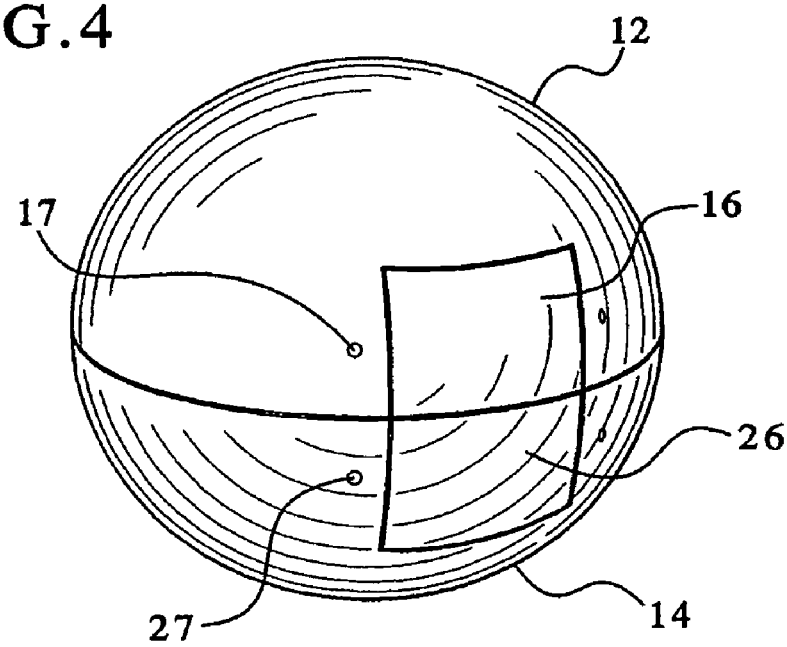
FIG. 4 is an enlarged perspective view of the embodiment of FIG. 1 illustrating the transformable toy in a closed position.

Referring now to FIGS. 1 to 4, in one embodiment, a transformable toy 10 includes a first movable member 12, a second movable member 14 and a coupler or hinge 20 connected between the first movable member and the second movable member. In one embodiment, the first movable member and the second movable member have corresponding semi-circular shapes. The first movable member is movably connected to one end of the coupler 20 and moves, pivots or rotates about a horizontal axis extending through the end of the coupler. Similarly, the second movable member 14 is movably connected to an opposite end of the coupler 20 and moves, pivots or rotates about a horizontal axis extending through the opposite end of the coupler. The first movable member 12 and the second movable member 14 are movable towards each other until the first and second movable members are substantially adjacent to each other or in a closed position as illustrated in FIG. 4. The first movable member 12 and the second movable member 14 are also movable away from each other to the open position as illustrated in FIG. 1. In this embodiment, the first movable member 12 and the second movable member 14 have semi-circular shapes and are the same size. It should be appreciated that the first and second movable members may have the same shape, different shapes or any suitable shapes. It should also be appreciated that the first and second movable members may be the same size, different sizes or any suitable size or sizes. In another embodiment, the coupler or hinge is integrally formed with the ends of the first movable member and the second movable member and enables the first and second movable members to pivot or move towards and away from each other as described above. In a further embodiment, the first and second movable members are hingedly connected to enable the first and second movable members to move or pivot towards and away from each other.

In one embodiment, a display member 13 is connected to an inside surface of at least one of the first and second movable members 12 and 14, respectively. In this embodiment, the display member 13 is a figure or figurine. It should be appreciated that the display member may be a figure, object, character, image, animal, shape or any other suitable configuration or object. In this embodiment, the display member 13 is a figure or figurine and includes a first revealer 16 formed as a head of the figure, a body 18 positioned adjacent to the first revealer 16, a pair of second revealers 24 in the form of arms movably connected to opposing sides of the body 18, a coupler 20 connected between the first and second movable members, a support 22 positioned adjacent to the coupler and a third revealer 26 positioned adjacent to the support 22 and movably connected to the second movable member. In another embodiment, the coupler 20 is attached to the outside surfaces of the first and second movable members. Therefore in this embodiment, the display member 13 does not include the coupler as part of the figure or object connected to the inside surfaces of the first and second movable members.

In one embodiment, the first movable member 12 has a semi-circular shape with a hollow interior portion as illustrated in FIG. 1. A body member or body 18 is connected to an inside surface of the first movable member 12. In one embodiment, the body 18 is a separate part fixedly connected to the inside surface of the first movable member using a suitable adhesive or other suitable attachment method. In another embodiment, the body 18 is integrally formed with the inside surface of the first movable member.

In one embodiment, a first revealing member or first revealer 16 is positioned adjacent to the top of the body 18 and movably connected to the first movable member 12. The first revealer includes a pivot member or pivot pin 17 which extends from each side of the first revealer 16. Each end of the pivot pin 17 is movably connected to the first movable member 12. In one embodiment, the pivot pin is a separate component that is attached to the first revealer. In another embodiment, the pivot pin 17 is integrally formed with the first revealer. The pivot pin 17 is adapted to enable the first revealer to move, pivot or rotate about a horizontal axis extending generally though one end of the first movable member 12. Specifically, the first revealer 16 is movable or rotatable from a concealed position shown in FIG. 3 to a revealed or exposed position shown in FIG. 1. It should be appreciated that the first revealer 16 may be moved from the concealed position to the revealed position or from the revealed position to the concealed position.

In one embodiment, the first revealer includes at least one surface having an image such as a face as shown in FIG. 1. The image or face is concealed or hidden when the first revealer is in the concealed position as shown in FIG. 3. The face is then revealed, exposed or viewable when the first revealer is moved to the revealed position as shown in FIG. 1. It should be appreciated that the each transformable toy 10 may include the same image or face, at least one different image or face or a plurality of different images or faces. It should also be appreciated that one or more surfaces of the first revealer 16 may include an image such as a face.

In one embodiment, at least one second revealing member or second revealer and preferably two second revealers 24 are movably connected to the body 18. In the illustrated embodiment, the second revealers 24 are formed as arms of the figurine. It should be appreciated that the second revealers 24 may be any suitable size or shape. The second revealers 24 are movably or rotatably connected to opposing sides of the body 18. It should be appreciated that the second revealers may be connected to any suitable side of the body. A connector such as a pivot pin (not shown) is connected to each of the second revealers 24 and the body 18 to enable the second revealers to move or rotate relative to the body. The second revealers 24 move from a retracted position as shown in FIG. 3 to a extended or un-retracted position as shown in FIG. 1. It should be appreciated that the second revealers may move from the retracted position to the extended position and from the extended position to the retracted position.

The body 18, the first revealer 16 (i.e., the head of the figurine) and the second revealers 24 (i.e., the arms of the figurine) cooperate or co-act to form the upper portion of the figurine connected to the inside surface of the first movable member 12.

In one embodiment, the second movable member 14 has a semi-circular shape with a hollow interior portion as illustrated in FIG. 1. A support member or support 22 is connected to an inside surface of the second movable member 14. In one embodiment, the support 22 is a separate part or component fixedly connected to the inside surface of the first movable member using a suitable adhesive or other suitable attachment method. In another embodiment, the support 22 is integrally formed with the inside surface of the second movable member.

In one embodiment, a third revealing member or third revealer 26 is positioned adjacent to the bottom of the support 22 and is movably connected to the second movable member 14. The third revealer includes a pivot member or pivot pin 27 which extends from each side of the third revealer 26. Each end of the pivot pin 27 is movably connected to the second movable member 14. In one embodiment, the pivot pin 27 is a separate component that is attached to the third revealer. In another embodiment, the pivot pin 27 is integrally formed with the third revealer. The pivot pin 27 is adapted to enable the third revealer to move, pivot or rotate about a horizontal axis extending generally though one end of the second movable member 14. Specifically, the third revealer 26 is movable or rotatable from a concealed position shown in FIG. 3 to a revealed, exposed or non-concealed position shown in FIG. 1. It should be appreciated that the third revealer 26 may be moved from the concealed position to the revealed position or from the revealed position to the concealed position.

In one embodiment, the third revealer 26 includes at least one surface having an image such as the feet shown in FIG. 1. The third revealer 26 (i.e., the feet of the figurine) is concealed or hidden when the third revealer is in the concealed position as shown in FIG. 3. The feet are then revealed, exposed or viewable when the third revealer is moved, pivoted or rotated away from the support 22 to the revealed position as shown in FIG. 1.

Additionally, the third revealer includes a receptacle or concave surface 30 which corresponds to the size and shape of the top surface 28 of the first revealer 16. The top surface 28 of the first revealer 16 fits into the receptacle 30 when the first movable member and the second movable member are moved towards each other to the closed position shown in FIG. 4. The mating engagement of the top surface 28 and the receptacle 30 enable the first and second movable members to close together.

The support 22 and the third revealer 26 (i.e., the feet of the figurine) cooperate or co-act to form the lower or bottom portion of the figurine connected to the inside surface of the second movable member 14.

Accordingly, the upper portion of the figurine connected to the inside surface of the first movable member 12 and the lower portion of the figurine connected to the inside surface of the second movable member 14 co-act to form the figurine of the transformable toy 10. It should be appreciated that any suitable figure, figurine, configuration, character or any other suitable object may be formed or connected to the inside surfaces of the first and second movable members.

In one embodiment, the toy 10 includes a locking member or lock (not shown). The lock is connected to at least one of the first and second movable members and is adapted to releasably secure the first and second movable members together when the first and second movable members are in the closed position. It should be appreciated that any suitable lock, latch or securing member may be attached to the first and/or the second movable member.

Figure 5:
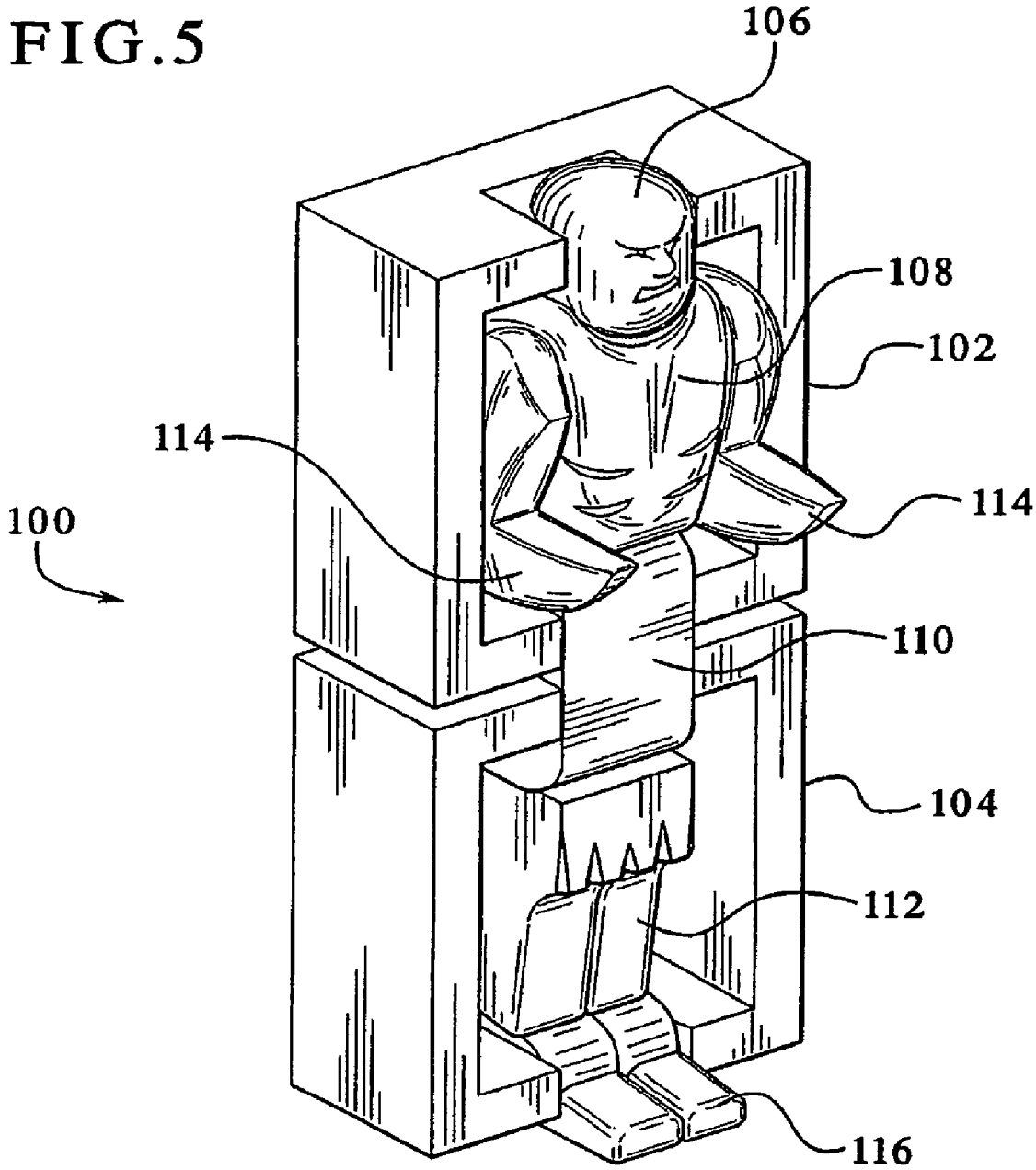
FIG. 5 is an enlarged perspective view of another embodiment of the transformable toy of the present invention.

Referring to FIG. 5, another embodiment of the present invention is illustrated where the transformable toy 100 includes a first movable member 102 and a second movable member 104 which each have a cube or generally square shape. In this embodiment, a first revealer 106 is rotatably attached to the first movable member 102 and positioned adjacent to the body 108. The toy also includes a pair of second revealers 114 formed as arms. A coupler 110 is rotatably connected to one end of each of the first second and second movable members 102 and 104, respectively. A support 112 in the formed as a pair of legs is connected to the inside surface of the second movable member 104. A third revealer 116 formed as feet is rotatably connected to the second movable member 104. It should be appreciated that the first movable member and the second movable member may be any suitable shape or configuration and have any suitable size.

Operation

Referring now to FIGS. 1 to 4, in one embodiment, the transformable toy 10 generally opens and closes to reveal or conceal an object such as a figurine attached to the inside surfaces of the toy. Initially, the first movable member 12 and the second movable member 14 of the toy are moved or pivoted towards each other about the coupler 20 to a closed position as shown in FIG. 4. In the closed position, the toy 10 forms a sphere or ball that can be rolled, bounced, thrown or spun. In this manner, the toy 10 can be used to play marbles or any other suitable game.

To open the transformable toy 10 to reveal the figurine inside the toy, a user separates the first and second movable members 12 and 14 respectively and pulls or pushes the first and second movable members apart. The user moves or pivots the first and second movable members apart about the coupler 20 until the first and second movable members are substantially apart or in the open position shown in FIG. 1. In the open position, the first movable member 12 is positioned adjacent to and above the second movable member 14 where the inside surfaces of the first and second movable members are facing or pointing in the same general direction as illustrated in FIG. 1.

When the transformable toy 10 is in the open position, the user moves or rotates the first revealer or head 16 of the figurine upwardly away from the inside surface of the first movable member 12. The head is moved or rotated upwardly until the face included on one surface of the head is facing outward from the head or substantially viewable as shown in FIG. 1. The user then moves or rotates one or more of the second revealers or arms 24 outwardly from the inside surface of the first movable member 12 to the extended position shown in FIG. 1. The arms 24 may be independently moved upwardly or downwardly relative to the body 18 to any suitable position or positions. The user then moves or rotates the third revealer or feet portion of the figurine 26 downwardly away from the support 22 until the bottom surface of the feet portion is transverse or perpendicular with the inside surface of the second movable member 14. The bottom surface of the feet portion 26 is substantially planar or flat to enable the toy 10 to stand upright on a flat surface such as a tabletop. After all of the revealing members or revealers are revealed or moved from the concealed position, the toy 10 can be used as a movable figure or figurine such as an action figure or other suitable character.

To return the toy 10 back to a closed position, the user moves or pivots the feet 26 upwardly towards the support 22, moves or pivots the arms inwardly towards the inside surface of the first movable member 12 and moves or pivots the head 16 downwardly and towards the inside surface of the first movable member as generally shown by the arrows in FIG. 3. Specifically, the feet 26 pivot to reveal a rounded surface which corresponds to the rounded outside surface of the second movable member 14 as shown in FIG. 4. Additionally, the receptacle 30 is positioned to engage the top surface 28 of the head 16. The arms 24 are pivoted inward and fit into corresponding open spaces or receptacle areas 29 defined by the second movable member 14 to enable the first and second movable members to close together. The head 16 moves or pivots to conceal the face and to align the rounded outside surface of the head 16 with the rounded outside surface of the first movable member 12. The user then moves or pivots the first and second movable members towards each other about the coupler 20 until the first and second movable members are substantially adjacent to each other in the closed position as shown in FIG. 4.

The transformable toy 10 of the present invention therefore provides excitement and enjoyment for users such as children because the toy 10 may be pivoted to a closed position and used as a ball. Also, the toy 10 may be opened to reveal a figure or figurine which can stand upright and used as an action figure or as a decorative display. It should be appreciated that the figurine may be any suitable figurine and have any suitable size, image, faces or shape. Additionally, the shape and size of the individual components, such as the movable members, the revealers, the body, the support or any other suitable components may be any suitable size, shape or configuration.

It should be appreciated that although the toy described above includes one or more revealing members or revealers, the toy may include no revealers (i.e., the figure or other object is formed on the inside surfaces of at least one of the first and second movable members), one revealer or a plurality of revealers.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A toy comprising:

a first member, a first surface of the first member being a first part of an exterior surface of a substantially spherical structure in a first configuration;

a second member, a second surface of the second member being a second part of the exterior surface of the substantially spherical structure in the first configuration, the first member and second member being positionable in a second configuration, wherein at least a portion of the second member is further from at least a portion of the first member in the second configuration, the at least a portion of the second member including a semi-circular shaped edge; and a third member, the first member, second member and third member being positionable in a third configuration, wherein the at least portion of the second member is further from the at least a portion of the first member in the second configuration and at least a portion of the third member is further from the at least a second portion of the second member in the third configuration, wherein the toy is balanceable on a flat surface with the third member touching the flat surface in the third configuration.

2. The toy of claim 1, wherein the first member is pivotally coupled to the second member.

3. The toy of claim 1, wherein the third member is pivotally coupled to the second member.

4. The toy of claim 1, wherein the second surface of the second member is approximately half of the substantially spherical structure in the first configuration.

5. The toy of claim 1, wherein a third surface of the third member is a third part of the exterior surface of the substantially spherical structure in the first configuration.

6. The toy of claim 1, wherein a head-shaped portion of a fourth member is exposable in the third configuration.

7. The toy of claim 1, wherein an arm-shaped portion of a fourth member is exposable in the third configuration.

8. The toy of claim 1, wherein the first member and the second member are coupled by a coupling member.

9. The toy of claim 1, further comprising a locking device, the locking device configured to releasably secure the first member and second member together in the first configuration.

10. The toy of claim 1, further comprising a latching device, the latching device configured to releasably secure the first member and second member together in the first configuration.

11. The toy of claim 1, further comprising a securing device, the securing device configured to releasably secure the first member and second member together in the first configuration.

12. The toy of claim 1, wherein the first member, second member and third member are parts of a figurine, the figurine being visible in the third configuration.

13. The toy of claim 1, wherein the first member includes a third surface, wherein for each first point on the first surface there is a corresponding second point on the third surface, the first point, second point and a center of the substantially spherical structure being collinear, and wherein a first tangential plane is substantially parallel to a second tangential plane, the first tangential plane being tangential to the first surface at the first point and the second tangential plane being tangential to the third surface at the second point.

14. The toy of claim 1, wherein the first member includes an internal surface, the internal surface being in the interior of the substantially spherical structure in the first configuration, the internal surface including a concave spherical curve portion.

15. The toy of claim 1, wherein the first member and the second member enclose a cavity in the first configuration.

16. The toy of claim 1, wherein the first member is a shell portion.

17. The toy of claim 1, wherein the toy is balanceable with a portion of the third member touching the flat surface in the third configuration, the portion of the third member being a portion of the exterior surface of the substantially spherical structure in the first configuration.

18. The toy of claim 1, wherein the toy is balanceable with a portion of the third member touching the flat surface in the third configuration, the portion of the third member being in the interior of the substantially spherical structure in the first configuration.

* * * * *